US009502776B2

(12) United States Patent
Di Nallo et al.

(10) Patent No.: US 9,502,776 B2
(45) Date of Patent: Nov. 22, 2016

(54) ANTENNA SURROUNDED BY METAL HOUSING

(71) Applicants: Carlo Di Nallo, Plantation, FL (US); Simone Paulotto, Rockville, MD (US)

(72) Inventors: Carlo Di Nallo, Plantation, FL (US); Simone Paulotto, Rockville, MD (US)

(73) Assignee: MAXTENA

( * ) Notice: Subject to any disclaimer, the term of this patent is extended or adjusted under 35 U.S.C. 154(b) by 385 days.

(21) Appl. No.: 13/841,744

(22) Filed: Mar. 15, 2013

(65) Prior Publication Data

US 2014/0111388 A1 Apr. 24, 2014

Related U.S. Application Data

(60) Provisional application No. 61/621,910, filed on Apr. 9, 2012, provisional application No. 61/767,773, filed on Feb. 21, 2013.

(51) Int. Cl.

| | |
|---|---|
| ***H01Q 1/24*** | (2006.01) |
| ***H01Q 9/42*** | (2006.01) |
| ***H01Q 5/00*** | (2015.01) |
| ***H01Q 13/10*** | (2006.01) |
| ***H01Q 1/22*** | (2006.01) |
| ***H01Q 5/364*** | (2015.01) |
| ***H01Q 5/378*** | (2015.01) |

(52) U.S. Cl.

CPC ..... *H01Q 13/106* (2013.01); *H01Q 1/2266* (2013.01); *H01Q 1/243* (2013.01); *H01Q 5/364* (2015.01); *H01Q 5/378* (2015.01); *H01Q 9/42* (2013.01); *H01Q 13/10* (2013.01)

(58) Field of Classification Search

CPC .... H01Q 1/2258; H01Q 1/2266; H01Q 1/24; H01Q 1/241; H01Q 1/242; H01Q 1/243; H01Q 1/44; H01Q 5/278; H01Q 5/385; H01Q 5/392; H01Q 9/0421; H01Q 13/10; H01Q 13/103; H01Q 13/106; H01Q 13/16; H01Q 13/18; H01Q 5/314; H01Q 5/328; H01Q 5/378

USPC ..... 343/702

See application file for complete search history.

(56) References Cited

U.S. PATENT DOCUMENTS

| | | | | |
|---|---|---|---|---|
| 6,100,849 | A * | 8/2000 | Tsubaki et al. | 343/702 |
| 6,518,922 | B1 * | 2/2003 | Hoffmeister | H01Q 9/0421 343/700 MS |
| 6,614,400 | B2 * | 9/2003 | Egorov | H01Q 1/243 343/700 MS |

(Continued)

FOREIGN PATENT DOCUMENTS

| | | |
|---|---|---|
| EP | 1973197 A1 | 9/2008 |
| EP | 2434576 A1 | 3/2012 |

*Primary Examiner* — Sue A Purvis
*Assistant Examiner* — Patrick Holecek

(57) ABSTRACT

An antenna system includes a metal housing including a first edge and a second edge that meet at a corner and a slot located proximate the second edge that extends from the first edge parallel to the second edge defining a strip and an antenna located behind and in close proximity to the strip. The antenna is coupled to the strip. A parasitic element is located proximate the antenna and the strip includes a ground coupling that crosses the slot in spaced relation thereto. The parasitic element assists in establishing second and third higher frequency modes of the antenna system.

21 Claims, 9 Drawing Sheets

(56) References Cited

U.S. PATENT DOCUMENTS

| | | | | |
|---|---|---|---|---|
| 6,870,504 | B2 * | 3/2005 | Ikegaya et al. | 343/700 MS |
| 7,595,759 | B2 * | 9/2009 | Schlub | H01Q 1/243 343/700 MS |
| 7,710,338 | B2 | 5/2010 | Fujishima et al. | |
| 8,779,999 | B2 * | 7/2014 | Gummalla | 343/767 |
| 2009/0066596 | A1 | 3/2009 | Fujishima | |
| 2011/0187610 | A1 | 8/2011 | von Arbin | |
| 2011/0254741 | A1 * | 10/2011 | Ishimiya | 343/702 |
| 2011/0260925 | A1 | 10/2011 | Chirila | |
| 2013/0076576 | A1 | 3/2013 | Avendal | |
| 2013/0154886 | A1 * | 6/2013 | Isohatala | H01Q 1/243 343/702 |
| 2014/0266928 | A1 | 9/2014 | Gummalla | |

* cited by examiner

FIG. 15
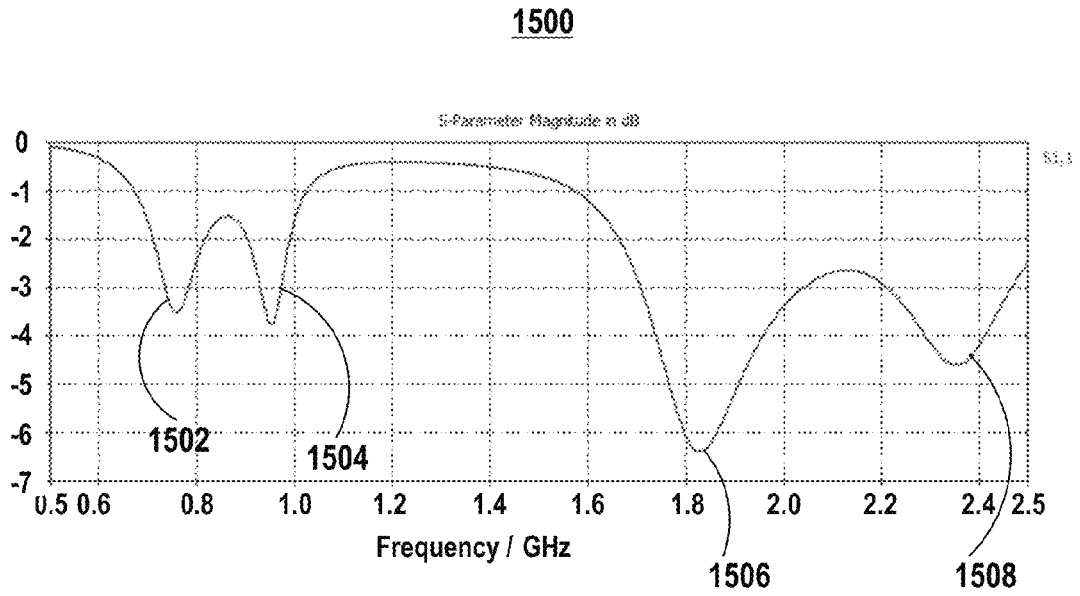
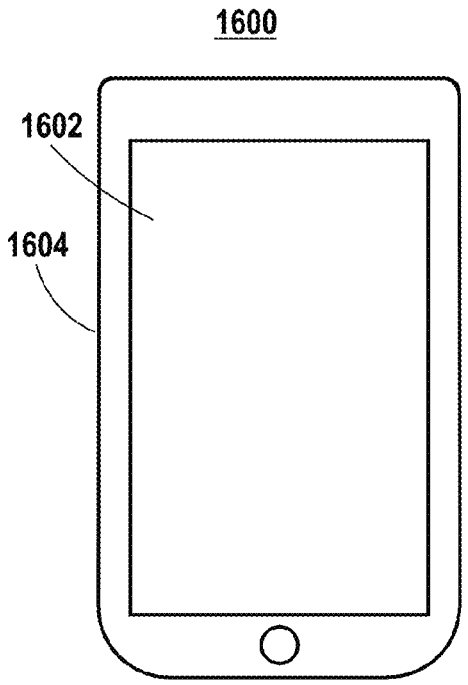
FIG. 16
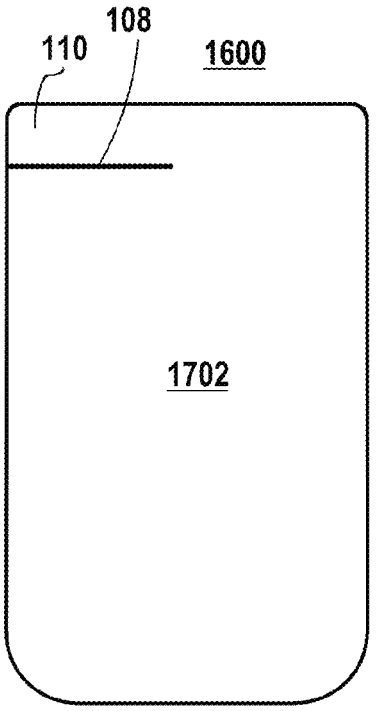
FIG. 17

ANTENNA SURROUNDED BY METAL HOUSING

RELATED APPLICATION DATA

This patent application is based on provisional patent application No. 61/621,910 filed Apr. 9, 2012 and provisional patent application No. 61/767,773 filed Feb. 21, 2013.

FIELD OF THE INVENTION

The present invention relates to antennas for consumer electronic devices.

BACKGROUND

Moore's Law in combination with advances in the miniaturization of packaging of electronics has enabled the development of highly functional consumer electronic devices with smaller and smaller housings. For example recently tablet computers and thin light weight "ultrabook" notebook computers that offer computer application functionality comparable to desktop computer are available. In these new devices one or more of the housing walls are sometimes made out of metal instead of plastics. Metal has advantages as far as thinness, strength, durability, appearance and heat dissipation-which is important given the density of electronics within the housings. Presently, for the most part, these consumer electronic devices are expected to provide wireless connectivity to wireless Local Area Networks (LANs) or cellular networks, or both. Typically consumer electronic devices such as notebook computers or tablet computers use internal antennas contained within their housings. Unfortunately metal blocks wireless signals (radio waves) which makes it problematic to make more of the device housing metal and incorporate internal antennas for wireless connectivity.

What is needed is an antenna that can be used inside a metal housing.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 15 is a return loss plot for the antenna system shown in FIGS. 11-14;

FIG. 16 is a front view of an consumer electronics device particularly a touch screen smart phone that includes the antenna system shown in FIGS. 1-9;

FIG. 17 is a back view of the consumer electronics device shown in FIG. 11.

Figure 1:
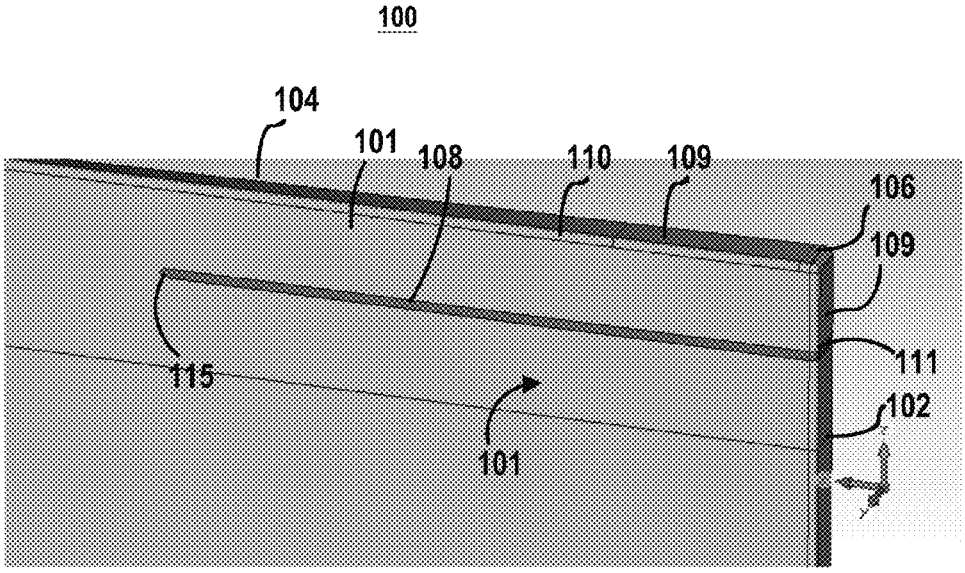
FIG. 1 is perspective view of a portion of a back side of a metal housing of a consumer electronics device that houses an antenna system according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to antenna systems. Accordingly, the apparatus components steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not necessarily include only those elements but may include other elements not expressly listed or inherent to such process, method, article, or apparatus. An element proceeded by "comprises . . . a" or "comprising" does not, without more constraints, preclude the existence of additional identical elements in the process, method, article, or apparatus that comprises the element.

FIG. 1 is perspective view of a portion of a back side of a metal housing 101 of a consumer electronics device that houses an antenna system 100 according to an embodiment of the invention. According to certain embodiments of the invention the housing 101 is part of a portable device. The metal housing 101 can be a housing of the top or bottom parts of a notebook computer, or the housing of a tablet computer or the housing of a smart-phone, for example. The housing 101 has a first edge 102 and a second edge 104 that meet at a corner 106. A slot 108 through the metal housing 101 extends proximate and parallel to the second edge 104 from the first edge 102. The slot 108 includes an open end 111 located at the first edge 102 and a closed end 115. The slot is associated with resonances corresponding to operating bands of the antenna system 100. The portion of the housing 101 shown is generally planar but includes a depending skirt 109 portion that extends perpendicularly to the plane of the housing 101 portion. In the FIGs. X-Y-Z coordinate system axes are indicated. The housing 101 is generally planar and disposed in plane parallel to the X-Z plane of the aforementioned coordinate system while the skirt extends in the negative Y direction at the periphery of the housing 101. Note that in the present description what is referred to as the back side faces the positive Y direction. In embodiments of the invention slots akin to slot 108 can be arranged to face either toward or away from users. The slot 108, the first edge 102 and the second edge 104 demarcate and bound on three sides a strip 110 portion of the metal housing 101. The strip 110 is the principle radiating component of the antenna system 100.

FIGS. 2-8 are various views of antenna system 100 elements that are located in front of the strip 110 portion and in an assembled electronic device would be contained within the metal housing 101. Note that the metal housing 101 shown in FIG. 1 can be used in combination with additional housing parts or device parts (e.g., a touch screen) to form an enclosed space used to house electronic circuits and other components.

Figure 2:
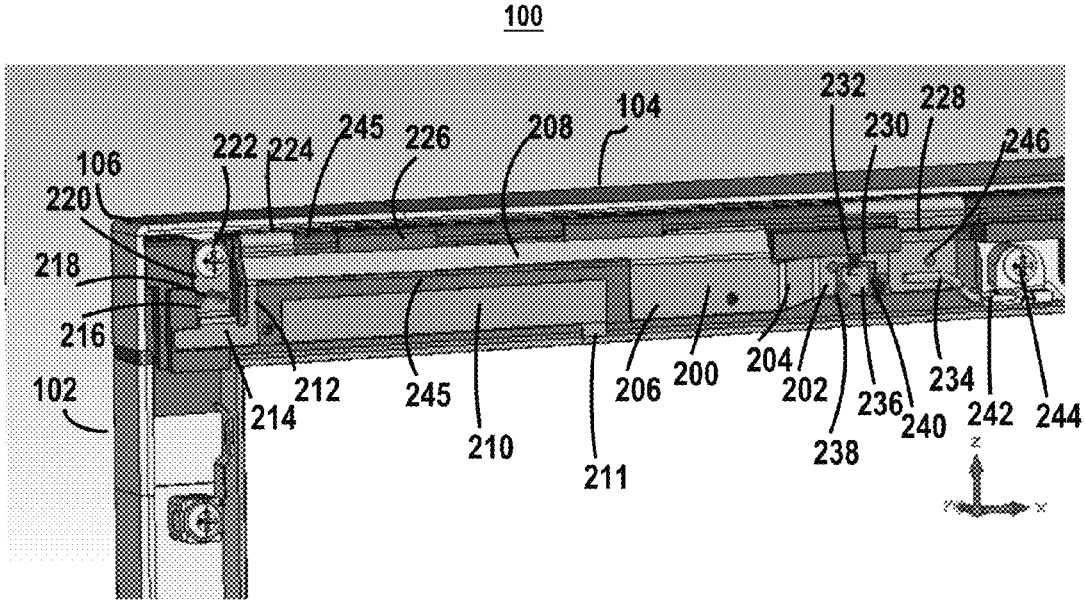
FIG. 2 is a perspective view of a front side of the antenna system housed in the housing shown in FIG. 1.
Figure 3:
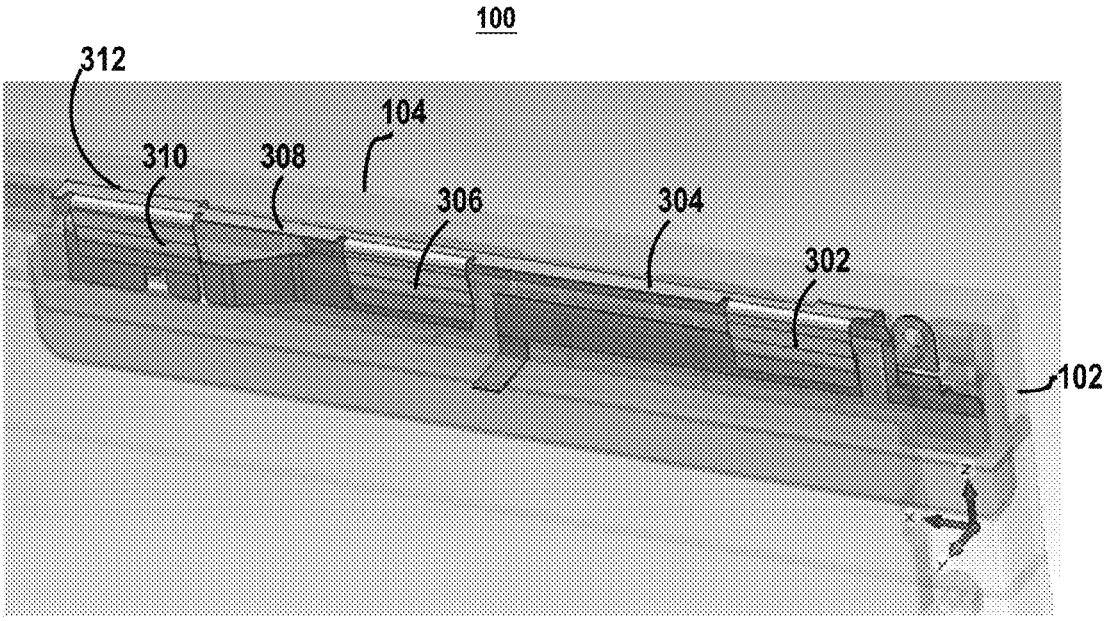
FIG. 3 is a back side x-ray view of the antenna system housing shown in FIG. 1 showing the antenna system shown in FIGS. 1-2.
Figure 4:
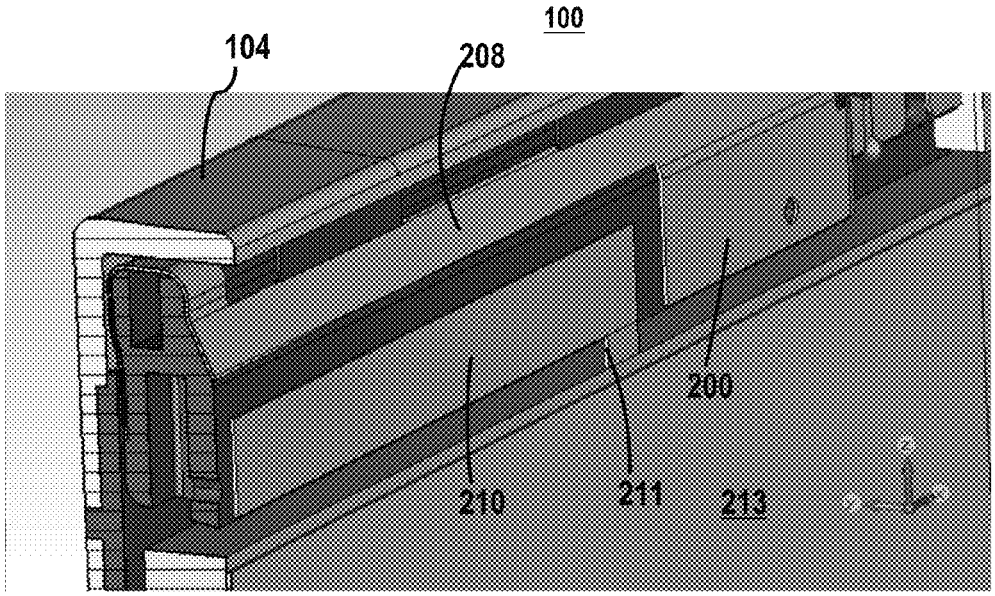
FIG. 4 is a cross-sectional perspective view of the antenna system shown in FIGS. 1-3.
Figure 5:
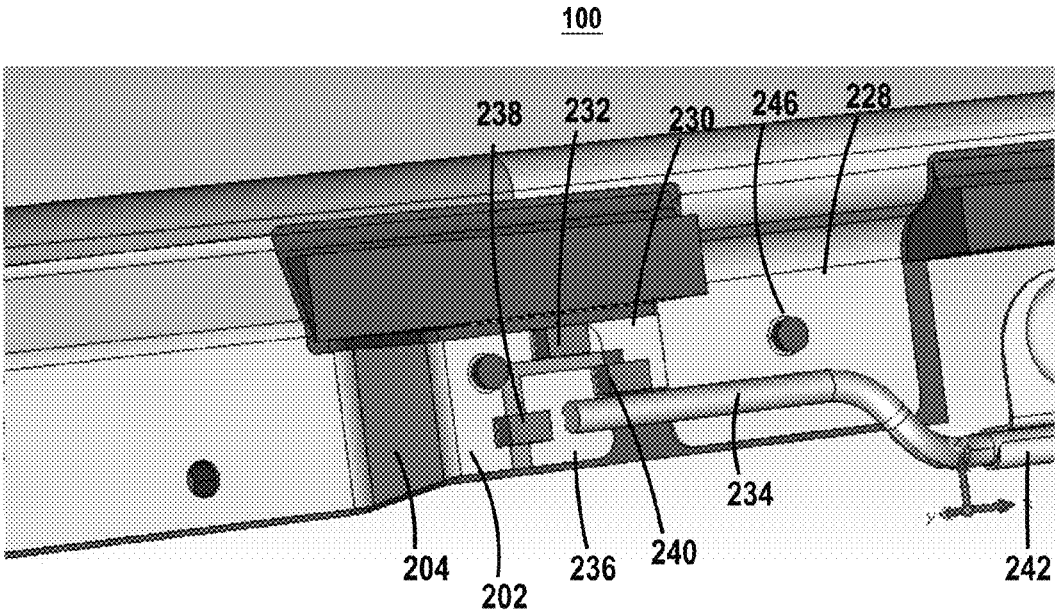
FIG. 5 is a close-up perspective view of a first portion of the antenna system shown in FIGS. 1-4 showing an impedance matching circuit.
Figure 6:
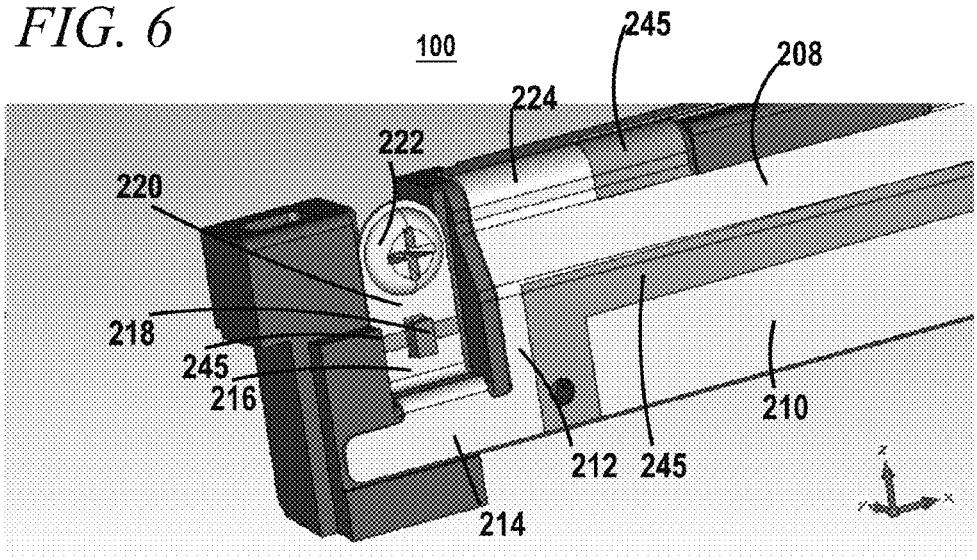
FIG. 6 is a close-up perspective view of a second portion of the antenna system shown in FIGS. 1-5.

Referring to FIGS. 2-8 a coupling structure 200 is shown. The coupling structure 200 includes a signal coupling portion 202 located in a plane parallel to the X-Z plane remote from the first edge 102 of the metal housing 101. The signal coupling portion 202 is connected to an angled portion 204 which is rotated about the Z-axis such that the left side extends out of the plane of the drawing sheet and to the left. The angled portion 204 connects to a wide portion 206 (tall in the perspective of FIG. 2) that extends further towards the first edge 102 of the metal housing 101. A first narrow strip portion 208 connects to the top of the wide portion 206 and extends to the further to the left in the negative X direction. The first narrow strip portion 208 is sufficiently narrow to accommodate a high frequency parasitic element 210 that is situated below the first narrow strip portion 208 and extends parallel to the narrow strip portion 208. The coupling structure 200 in combination with the parasitic element 210 form an excitation system for the strip 110 of the metal housing 101 that allows the strip 110 to radiate in multiple frequency bands. A grounding tab 211 depends from the right side of the parasitic strip 210. The grounding tab 211 can connect to the metal housing 101 or to another grounded structure 213 (e.g. circuit board ground plane, metal component shield) that is located in the housing 101. The grounding tab is located at a point between the open end 111 and the closed end 115 of the slot 108 but in spaced relation from the slot 108. A narrower vertical strip portion 212 connects to the left end of the first narrow strip portion 208 and extends downward in the negative Z direction. A short narrow horizontal strip 214 connects to the narrower vertical strip portion 212 and extends further in the negative X direction. A first terminal portion 216 extends off the top of the horizontal strip 214. A discrete capacitor 218 is connected between the first terminal portion 216 and a second terminal 220 that is separate from the coupling structure 200. A first screw 222 connects the second terminal to the metal housing proximate the corner 106. The screw 222 threads into a screw boss 902 (FIG. 9) that is integral to the metal housing 101. Referring to FIGS. 2-3 it is seen that a first bridge strip portion 224 extends from the top edge of the first narrow strip 208 at its left end. The first bridge strip portion 224 extends up and over a dielectric support 226 on which the coupling structure 200 is supported. The dielectric support 226 is suitably made of plastic but is alternatively made of another type of dielectric material. The first bridge strip portion 224 passes proximate the second edge 104 of the metal housing 101. The first bridge strip portion 224 connects to a first large area depending tab 302 that is located between the dielectric support 226 and the strip 110 defined in the metal housing 101 by, inter alia, the slot 108. A second narrow strip portion 304 extends from the top of the first large area depending tab 302 parallel to the second edge 104 of the metal housing (in the positive X direction). The second narrow strip portion 304 connects to a second large area depending tab 306. The second large area depending tab 306 is also located between the dielectric support 226 and the strip 110. A third narrow strip 308 extends from the top of the second large area depending tab 306 parallel to the second edge 104 continuing in the positive X direction. The third narrow strip 308 connects to a third large area depending tab 310. The third large area depending tab 310 is also located between the dielectric support 226 and the strip 110. The large area tabs 302, 306, 310 are suitably spaced from the metal housing 101 by less than 1.0 millimeters by dielectric layer or coating on at least parts of the coupling structure 200. For example the coupling structure 200 can take the form of a flex circuit in which case the aforementioned dielectric layer or coating can take the form of the insulation layer normally used in flex circuits. The large area depending tabs 302, 306, 310 along with the discrete capacitor 218 serve to capacitively couple the coupling structure 200 to the strip 110. The large area depending tabs 302, 306, 310 serve as a distributed capacitive coupling arrangement for coupling excitation signals to the strip 110. As mentioned above the coupling structure 200 can take the form of a flex circuit, however alternatively the coupling structure 200 as well as the parasitic element 210 can be formed by laser direct structuring of a plastic molded part. As known in the art, laser direct structuring involves writing a 3-D latent pattern onto the surface of molded plastic followed by one or more metallization steps.

A second bridge strip portion 312 extends from the top of the third large area depending tab 310 over the dielectric support 226 to a depending tab area 228. A locating boss 246 protruding out of the dielectric support extends through a hole in the depending tab and helps to located the depending tab 228 and the antenna 200 as a whole. A connecting portion 230 extends from the depending tab area 228 towards the signal coupling portion 202 thus nearly completing a loop. The aforementioned loop is completed through a second discrete impedance device 232 (the discrete capacitor 218 being the first) which connects the connecting portion 230 to the signal coupling portion 202. The second discrete impedance device 232 is suitably a capacitor.

A miniature coaxial cable 234 runs in the negative X direction over the depending tab area 228, to a coax terminating pad 236 that is disposed between the signal coupling portion 202 and the connecting portion 230. On outer conductor of the miniature coax cable 234 is connected to depending tab 228 and an inner conductor of the miniature coaxial cable 234 is connected to terminating pad 236. A third discrete impedance device 238 connects the signal coupling portion 202 to the coax terminating pad 236 and a fourth discrete impedance device 240 connects the terminating pad 236 to the depending tab area 228. The second through fourth impedance devices 232, 238, 240 form an impedance matching network that matches the impedance of the coupling structure 200 to the impedance of the miniature coaxial cable 234. A retention clip 242 secured by a second screw 244 secures and grounds the miniature coaxial cable 234 to the metal housing 101.

Figure 7:
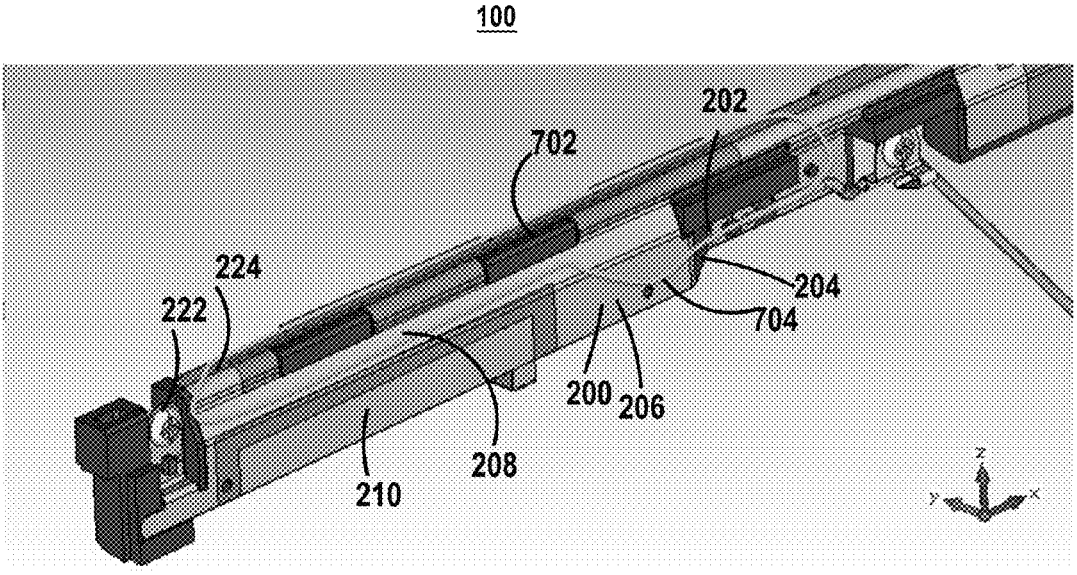
FIG. 7 is a perspective view of the antenna system shown in FIGS. 1-6 showing a loop current path that is postulated to exist when the antenna system is operating.

As seen most clearly in FIG. 7 the coupling structure 200 includes a slot 702. There is a loop path 704 around the slot 702. The loop path 704 passes through the signal coupling portion 202, angled portion 204, wide portion 206, narrow strip 208, first bridge portion 224, first large area depending tab 302, second narrow strip 304, second large area depending tab 306, third narrow strip 308, third large area depending tab 310, second bridge strip 312, depending tab 228, connecting portion 230 and the second discrete impedance device 232. Providing the slot 702 and the above described loop path 704 around the slot 702 helps to bring the impedance of the coupling structure 200 into a range that can be matched to the miniature coaxial cable 234.

Figure 8:
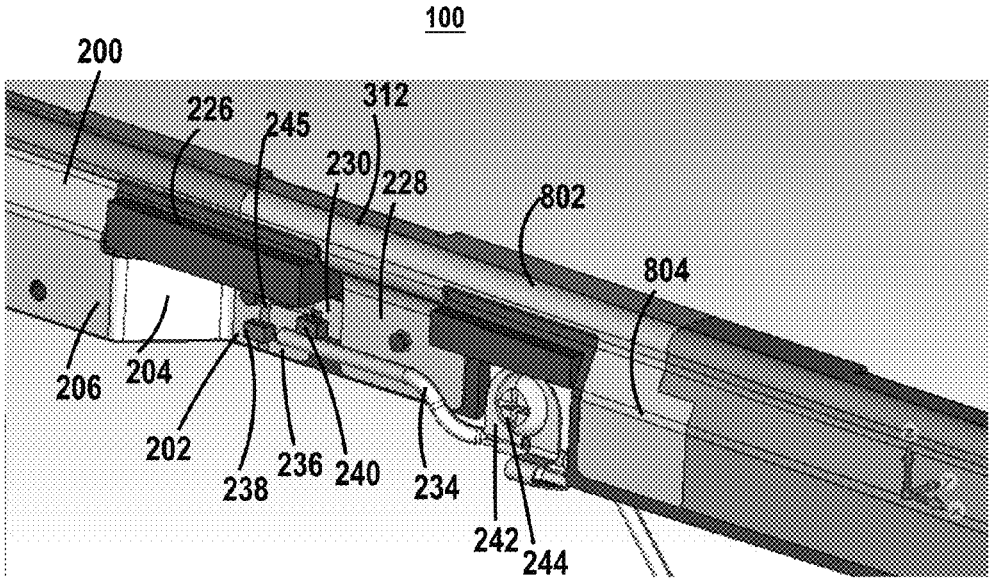
FIG. 8 is a close-up perspective view of a third portion of the antenna system shown in FIGS. 1-7 showing an appendage for supporting a second high frequency band.
Figure 9:
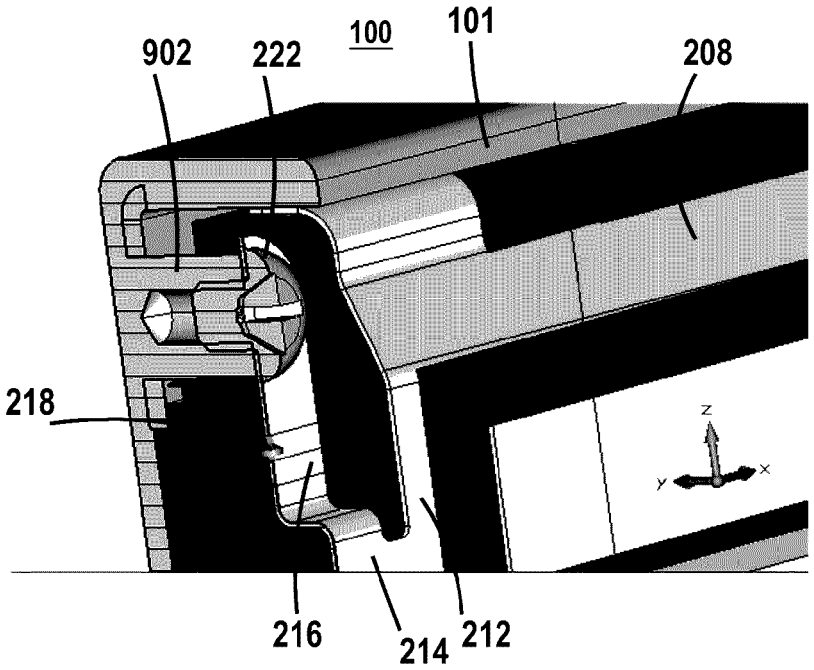
FIG. 9 is a cross-sectional view showing a portion of the antenna system shown in FIGS. 1-7 showing a distal end of a coupling structure grounded by a screw to a screw boss that is integral to the metal housing.

As shown most clearly in FIG. 8 the coupling structure 200 includes a back extension 802 that extends away from the rest of the antenna, in the positive X direction from the second bridge strip 312. The back extension 802 includes a depending tab 804 that extends down in the negative Z direction on the front side (negative Y direction side) of the dielectric support 226. The back extension 802 supports an additional high frequency operating band resonance. The coupling structure 200, parasitic element 210, second terminal 220 and coax terminating pad 236 are suitably implemented as a flex circuit and include non-metalized areas 245 that serve to maintain the spacial relationship between the various parts of the antenna 200 and aforementioned elements 210, 220, 236.

Figure 10:
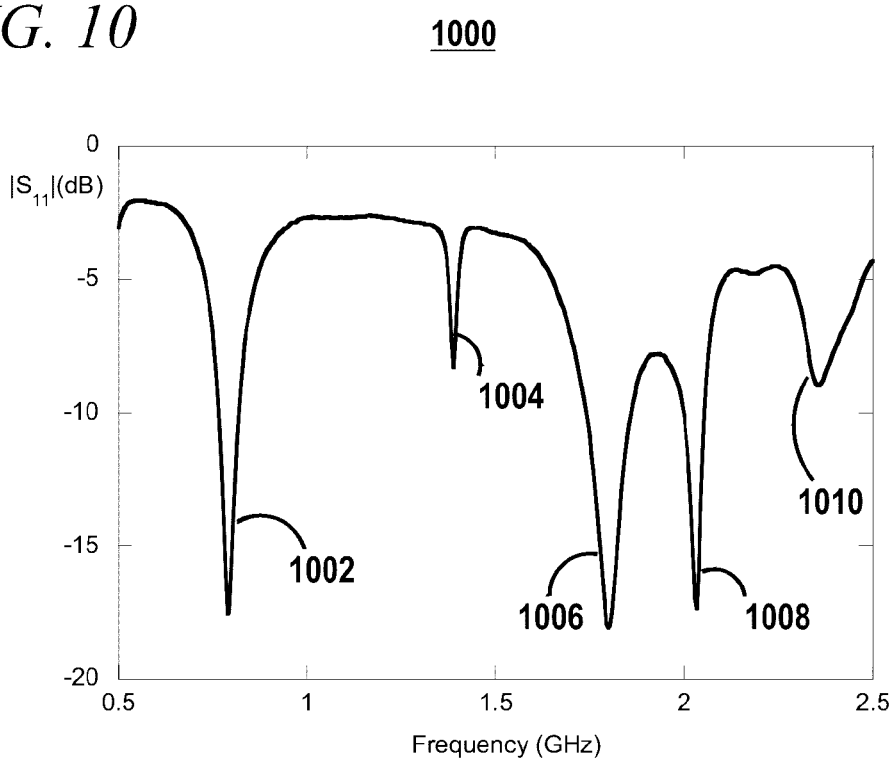
FIG. 10 is a return loss plot for the antenna system shown in FIG. 1-9.

FIG. 10 is a return loss plot 1000 for the antenna shown in FIG. 1-9. The abscissa indicates frequency in GHz and the ordinate indicates the magnitude of return loss in dB. The plot includes five inverted peaks 1002, 1004, 1006, 1008, 1010 corresponding to frequencies at which power delivered to the antenna is not rejected back into the antennas feed network. Proceeding from left to right (low frequency to high frequency) a first peak 1002 corresponds to a radiating mode associated with a ¼λ resonance of the slot 108 in the housing A second small peak 1004 corresponds to a non-radiating mode of the antenna 200. A third peak 1006 corresponds to a ¼λ resonance of the slot 108 as effectively shortened by the grounding tab 211 of the high frequency parasitic element 210 (although there is no actual physical contact between the grounding tab 211 and the slot 108). A fourth peak 1008 corresponds to a ¼λ resonance of the parasitic element 210 itself. The third 1006 and fourth 1008 peaks are close enough to merge into a single operating band. Finally a fifth peak 1010 corresponds to a resonance of the back extension 802 which includes the depending tab 804. While not wishing to be bound to any particular theory of operation, it is believed that while the parasitic element 210 being behind the metal housing 100 does not itself radiate, the high currents that occur in the grounding tab 211 when the parasitic element 210 is resonating effectively shorten the slot 108.

Figure 11:
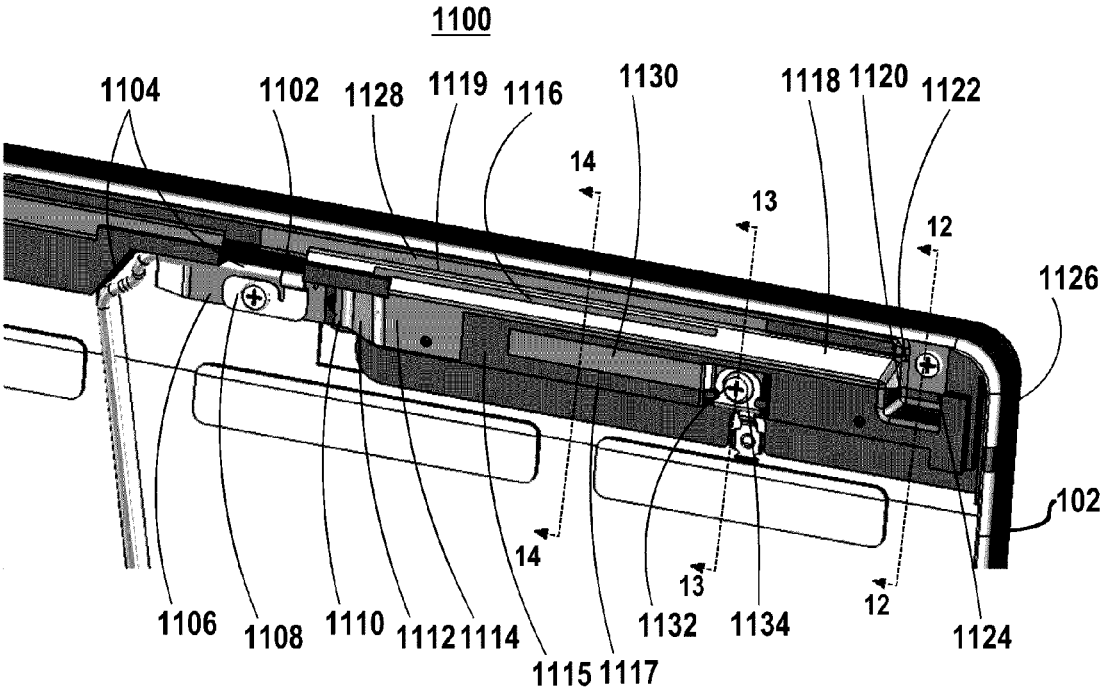
FIG. 11 is a perspective view of a front side of an antenna system according to an alternative embodiment of the invention.
Figure 12:
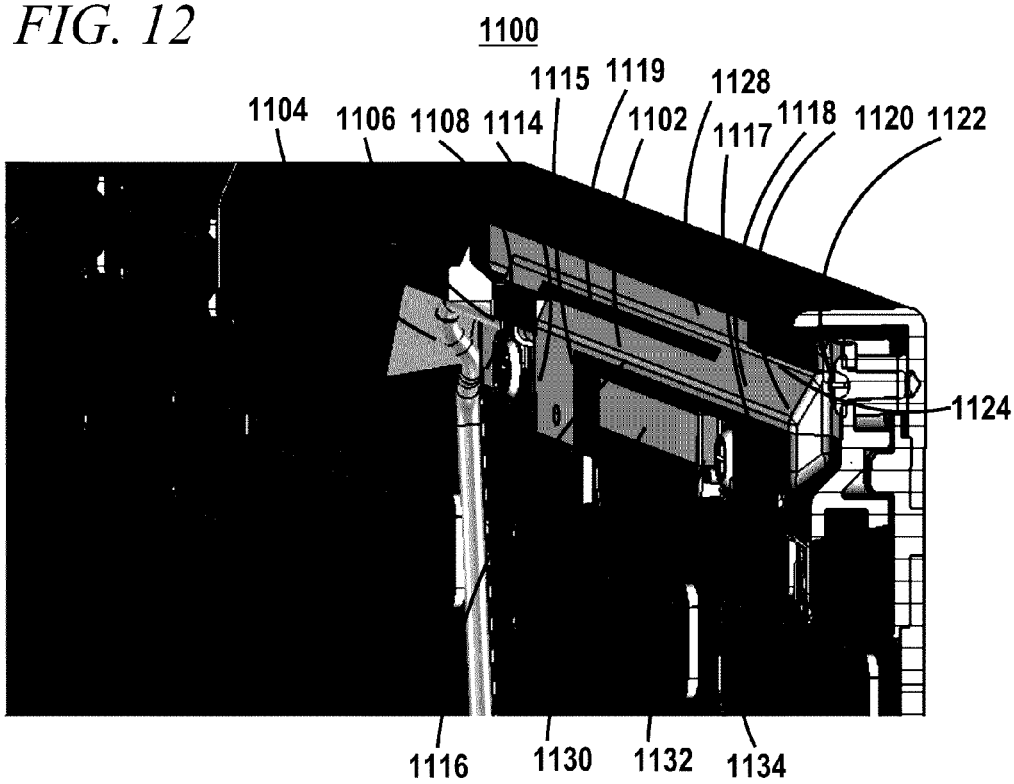
FIG. 12 is first cross sectional view of the antenna system shown in FIG. 11.
Figure 13:
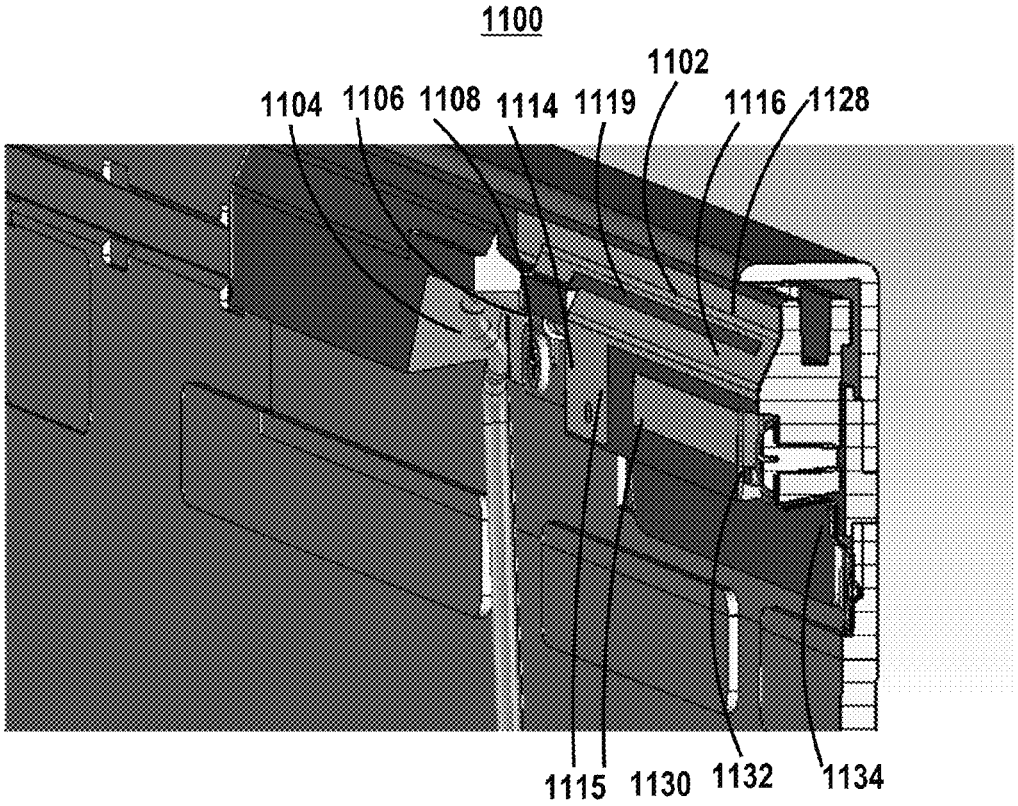
FIG. 13 is second cross sectional view of the antenna system shown in FIG. 11.
Figure 14:
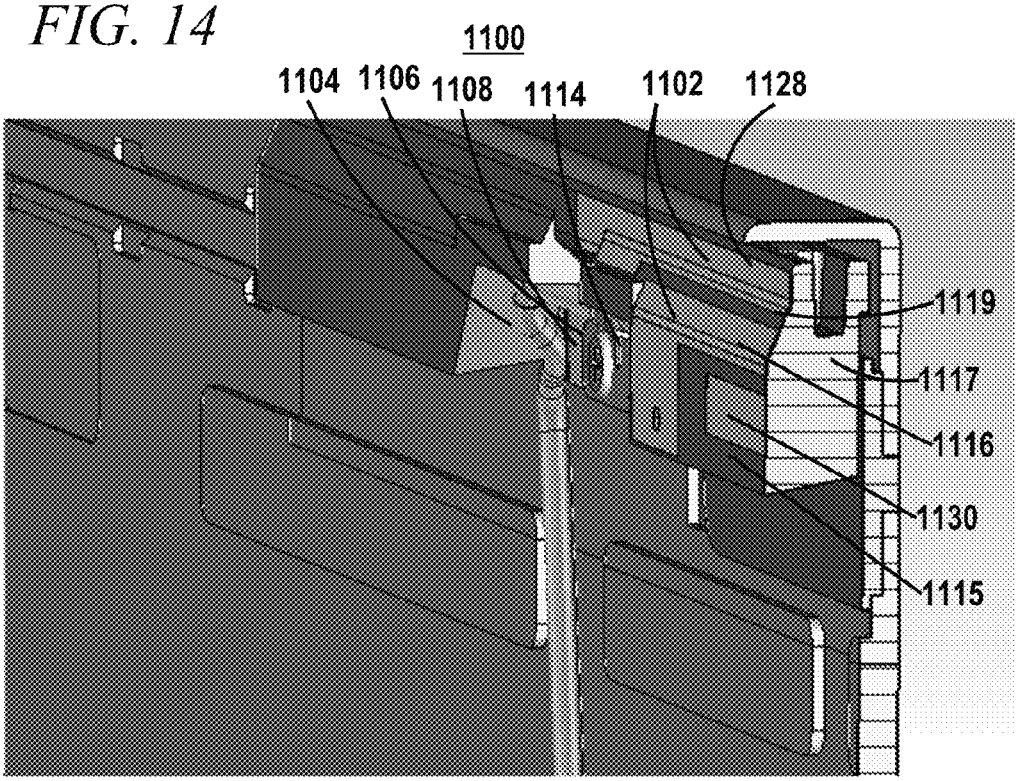
FIG. 14 is third cross sectional view of the antenna system shown in FIG. 11.

FIG. 11 is a perspective view of a front side of an antenna system 1100 according to an alternative embodiment of the invention and FIGS. 12-14 show three cross sectional views of the antenna system 1100 shown in FIG. 11. The antenna system 1100 includes an alternative coupling structure 1102 housed in the metal housing 101. A co-axial cable 1104 is secured with by a retention clip 1106 that is secured by a first screw 1108, that threads into the metal housing 101 and provides galvanic contact to the metal housing 101. The co-axial cable 1104 couples signals to and from a signal coupling portion 1110. The closed end of the slot 108 is located under the signal coupling portion 1110. The signal coupling portion 1110 joins an angled portion 1112 which extends toward the front (out of the plane of the drawing sheet) as it extends to the right (in the perspective of FIG. 11). The angled portion 1112 joins a wide portion 1114 that extends to the right. A narrower strip portion 1116 extends to the right from the top of the wide portion 1114. An intermediate width strip portion 1118 extends further to the right (toward the first side 102 of the housing 101). The wide portion 1114 is on a vertical (in the perspective of FIG. 11) surface 1115 of an coupling structure support 1117. In contrast the narrow strip portion 1116 and the intermediate width strip portion 1118 are on an angled surface 1119 that extends at an inclined upward (in the perspective of FIG. 11) angle from the top (in the perspective of FIG. 11) of the vertical surface 1115. A terminating portion 1124 of the intermediate width portion 1118 bends down into a recess 1120. A second screw 1122 located in the recess 1120 galvanically connects the terminating portion 1124 to a free end 1126 of the strip 110. A backwardly extending strip portion 1128 extends in a direction away from the first side 102 of the metal housing, parallel to the narrow strip portion 1116 from the juncture narrow strip portion 1116 and the intermediate width strip portion 1118. The backwardly extending strip portion 1128 is located on the angled surface 1119 between the narrower strip portion 1116 and the housing 101.

A parasitic element 1130 extends to the left from a grounding screw 1132 toward the wide portion 1114. The parasitic element 1130 is positioned proximate and overlying the metal strip 110. The grounding screw 1132 establishes electrical contact between the parasitic element 1130 and a conductive metal clip 1134. The conductive metal clip 1134 crosses over the metal slot 108 makes electrical contact with a portion of the metal housing 101 below the strip 110 and the slot 108. Although not wishing to be bound to any particular theory of operation, it is believed that the parasitic element 1130 does not act as the effective radiating element, rather the parasitic element 1130 aids in establishing a second higher frequency resonance of the strip 110 and slot 108, by effectively shortening the strip 110 when the antenna system 1100 is driven at the second higher frequency. It is believed that the backwardly extending strip portion 1128 aids in increasing the strength of the oscillation of the coupling structure 1102 when operating at a frequency corresponding to the resonance of the parasitic element 1130 and thereby aids in coupling energy to the parasitic element 1130.

FIG. 15 is a return loss plot 1500 for the antenna system 1100 shown in FIGS. 11-14. The abscissa indicates frequency in GHz and the ordinate indicates the magnitude of return loss in dB. Although not wishing to be bound to any particular theory of operation certain theories are set forth below ascribing peaks in the return loss to certain modes of operation of the antenna system 1100. The plot includes four inverted peaks 1502, 1504, 1506, 1508 corresponding to frequencies at which power delivered to the antenna system 1100 is not rejected back into the antenna system's feed network.

Proceeding from left to right (low frequency to high frequency) a first peak 1502 corresponds to a first radiating mode associated with a ¼λ resonance of the strip 110 of the housing 101. The frequency of the first radiating mode can be tuned by adjusting the length of the slot 108 and the strip 110. The first radiating mode frequency may also be adjusted by changing the location at which the conductive clip 1134 is connected to the metal housing 101. Shifting the latter location towards the towards the free end 1126 of the strip 110 lowers the frequency of the first radiating mode and shifting towards the signal coupling portion 1110 raises the frequency of the first radiating mode.

A second small peak 1504 corresponds to an inefficiently radiating mode of the antenna system 1100.

A third peak 1506 corresponds to a second radiating mode which corresponds to a ¼λ resonance of a portion of the strip 110 extending from the location at which the parasitic strip 1130 is grounded to the free end 1126 of the strip. The frequency of the second radiating mode is also varied by changing the location at which the conductive clip 1134 is connected to the metal housing 101. Moving the latter location towards the free end 1126 of the strip 110 raises the frequency of the second radiating mode. The frequency of the second radiating mode is also controlled by the length of the parasitic element 1130. Impedance matching the second radiating mode can be effected by adjusting the gap between the parasitic element 1130 and the antenna 1102 and also by adjusting the length of the backwardly extending strip 1128 and adjusting the position of the point at which the backwardly extending strip connects to the narrow strip portion 1116. Good performance is obtained when the latter position is proximate the position at which the parasitic element 1130 is grounded. A fourth peak 1508 corresponds to a third radiating mode which is analogous to a ¾λ resonance of the of the strip 110. The frequency of the third radiating mode can be adjusted by adjusting the length of the slot 108 between its closed end and the location at which the parasitic strip 1130 is grounded. The impedance matching and to some extent also the frequency of the third radiating mode are also controlled by the length of the backwardly extending strip 1128. If the backwardly extending strip 1128 is extended the third resonance tends to shift lower and merge with the second resonance.

The third 1506 and fourth 1508 peaks are close enough to merge into a single operating band.

The antenna system 1100 is suitable for supporting communications in the LTE/Cellular band from 750 MHz to 900 MHz and the cellular bands from 1710 MHz to 2170 MHz.

FIG. 16 is a front view of a consumer electronics device particularly a touch screen smart phone 1600 that includes the antenna system shown in FIGS. 1-9 or the antenna system shown in FIG. 11-14. The device 1600 includes front side touch screen 1602 surrounded by a bezel 1604 which can be conductive or dielectric.

FIG. 17 shows a back side housing part 1702 of the smart phone 1600 shown in FIG. 16. The back side housing part 1702 is metal but includes the includes the slot 108, demarcating strip portion 110 behind which the antenna 200 or alternatively the antenna 1100 is located.

Figure 18:
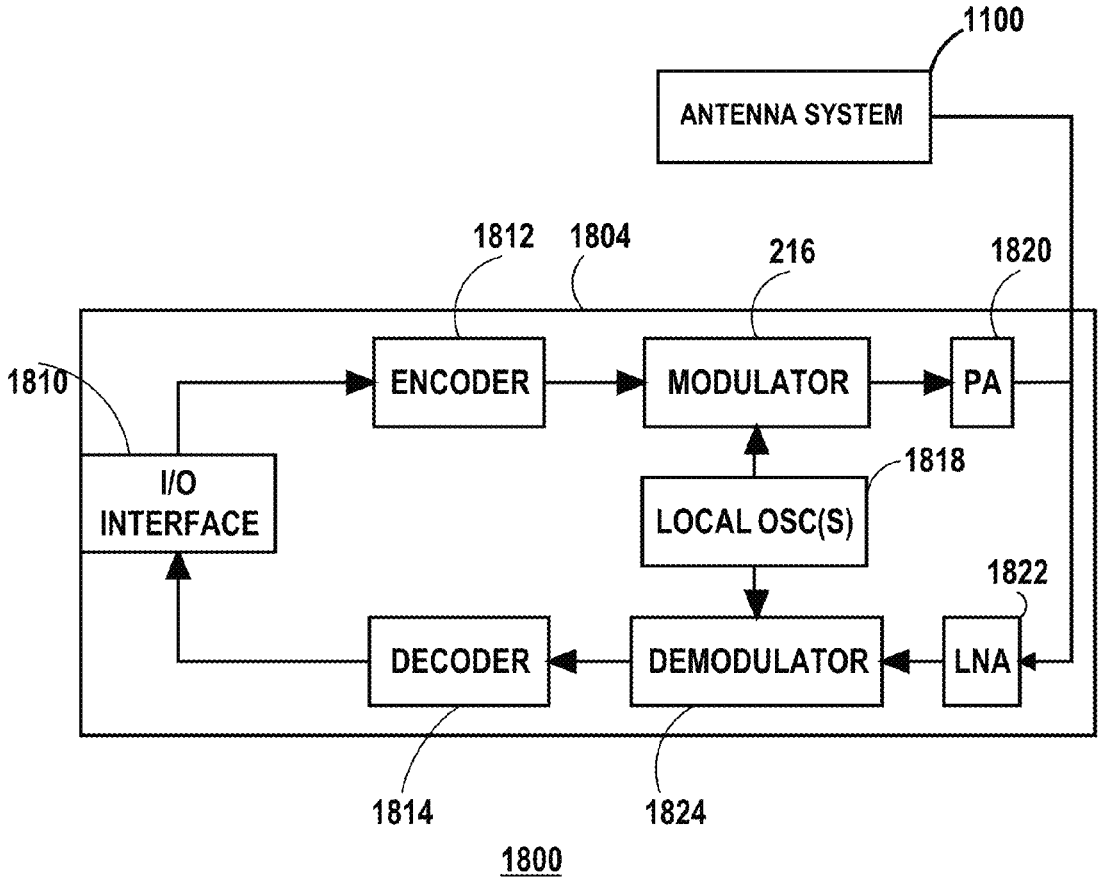
FIG. 18 is a block diagram of a communication system that includes the antenna system shown in FIGS. 11-14 according to an embodiment of the invention.

FIG. 18 is a block diagram of a communication system 1800 that includes the antenna system 1100 shown in FIGS. 11-14 according to an embodiment of the invention and includes a transceiver 1804. The transceiver 1804 comprises an input/output (I/O) interface 1810 coupled to an encoder 1812 and a decoder 1814. The I/O interface 1810 is used for coupling to data sources and/or data sinks included in larger systems in which the communication system is used, for example for coupling to audio and video processing systems of a laptop, tablet or smartphone in which the communication system 1800 is used. The encoder 1812 is coupled to a modulator 1816. At least one local oscillator 1818 is also coupled to the modulator 1816. The modulator 1816 modulates a carrier signal based on input from the encoder 1812. The output of the modulator 1816 is coupled to a power amplifier 1820. A low noise amplifier 1822 is coupled to a demodulator 1824. The at least one local oscillator 1818 is also coupled to the demodulator 1824. The output of the demodulator 1824 is coupled to the decoder 1814. Both the power amplifier 1820 and the low noise amplifier 1822 are coupled to the antenna system 1100 through the co-axial cable 1104.

The at least one local oscillator 1818 operates at multiple frequencies so as to establish multiple operating bands of the communication system 1800. The at least one local oscillator 1818 operates at a first frequency corresponding to the first peak 1502 of the return loss of the antenna system 1100 so as to establish a first operating band of the communication system 1800. The at least one local oscillator 1818 operates at a second frequency corresponding to the third peak 1506 of the return loss of the antenna system 1100 so as to establish a second operating band of the communication system 1800. The first and second operating bands are located in frequency ranges that include the first 1502 and third 1506 peaks respectively. The second operating band of the communication system may also overlap the fourth peak 1508 of the return loss of the antenna system.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An electronic device comprising an antenna system including:

a metal housing wall including at least one slot defining a strip portion of said metal housing wall, said slot including an open end and a closed end;

a coupling structure located proximate said strip portion of said metal housing wall and coupled to said strip portion;

said coupling structure including a current loop path that is completed outside said metal wall; and wherein said current loop path is coupled to said strip portion by a connection selected from the group consisting of a galvanic connection and a connection through a discrete capacitor.

2. The electronic device according to claim 1 wherein:

said metal housing wall includes a corner, a first edge and a second edge that meet at said corner and wherein said slot extends from the open end which is disposed at said first edge proximate to and parallel to said second edge to said closed end, wherein said metal strip portion of said metal housing wall is bounded on three sides by said slot, said second edge and said first edge.

3. The electronic device according to claim 2 wherein said coupling structure includes at least one part that is spaced from said metal strip portion by less than 1.0 millimeters whereby capacitive coupling of said coupling structure to said metal strip portion is enhanced.

4. The electronic device according to claim 1 wherein said coupling structure includes a depending tab that extends proximate said metal strip portion whereby capacitive coupling of said coupling structure to said metal strip portion through said depending tab is enhanced.

5. The electronic device according to claim 1 wherein said current loop path includes at least one discrete series capacitor.

6. The electronic device according to claim 1 including a signal feed line including a ground conductor and a signal conductor wherein at least one of said ground conductor and said signal conductor is coupled to said coupling structure through a first discrete impedance device, whereby an impedance of said signal feed line is matched to an impedance of said antenna.

7. The electronic device according to claim 6 wherein said signal conductor is coupled to said coupling structure through said first discrete impedance device and said ground conductor is coupled to said coupling structure through a second discrete impedance device.

8. The electronic device according to claim 1 further comprising a parasitic element that is disposed proximate to said coupling structure.

9. The electronic device according to claim 8 wherein said parasitic element includes a grounding tab that is positioned in spaced relation from said slot between said open end of said slot and said closed end of said slot.

10. The electronic device according to claim 9 wherein said coupling structure and said parasitic element extend parallel to said strip and wherein said parasitic element establishes a frequency band of operation of said antenna system that corresponds to an electrical length that is shorter than an electrical length of said strip.

11. The electronic device according to claim 2 wherein said coupling structure is coupled to said metal strip proximate said first edge.

12. The electronic device according to claim 11 wherein said coupling structure is galvanically coupled to said metal strip.

13. The electronic device according to claim 11 wherein said coupling structure is capacitively coupled to said metal strip.

14. The electronic device according to claim 2 wherein said coupling structure extends parallel to said metal strip from a signal coupling portion to a point proximate said first edge.

15. The electronic device according to claim 14 wherein said coupling structure includes a backwardly extending strip that extends in a direction away from said first edge from a point intermediate along the length of said coupling structure.

16. The electronic device according to claim 2 further comprising a parasitic element positioned proximate and parallel to said coupling structure and proximate and parallel to said metal strip.

17. The electronic device according to claim 16 wherein said parasitic element is grounded by a conductor that crosses over said slot.

18. The electronic device according to claim 1 wherein said strip portion of said metal housing includes a free end and said current loop path is coupled to said free end of said strip portion.

19. The electronic device according to claim 16 wherein said coupling structure includes a backwardly extending strip that extends in a direction away from said first edge from a point intermediate along the length of said coupling structure.

20. A wireless communication device comprising:

an antenna system including:

a metal part including: a slot formed in said metal part defining a strip;

a coupling structure coupled to said strip;

a parasitic element disposed proximate said coupling structure substantially overlying said strip in spaced relation to said strip;

a grounding conductor extending from said parasitic element and galvanically coupled to a ground;

said strip is dimensioned to support a first fundamental resonance;

said parasitic element grounded by said grounding conductor establishes at least one additional resonance of said antenna system that is associated with at least one portion of said strip on one side of a location where said grounding conductor is connected to said ground; and said wireless communication device includes a transceiver coupled to said antenna system, wherein said transceiver operates at a first frequency that is within a first frequency band established by said first fundamental resonance and said transceiver operates at a second frequency that is within a second frequency band established by at least one of said additional resonances.

21. The wireless communication device according to claim 20 wherein said metal part includes a first edge and a second edge that meet at a corner, said slot extends from said first edge proximate and parallel to said second edge and said parasitic element is oriented parallel to said strip.

* * * * *